United States Patent [19]

Saotome

[11] Patent Number: 4,647,617

[45] Date of Patent: Mar. 3, 1987

[54] WATER ABSORBENT CROSSLINKED POLYMER AND A METHOD OF PRODUCING THE SAME CONTAINING CELLULOSIS FIBERS

[75] Inventor: Kazuo Saotome, Tokyo, Japan

[73] Assignee: Hayashikane Shipbuilding & Engineering Co., Ltd., Japan

[21] Appl. No.: 819,790

[22] Filed: Jan. 16, 1986

[30] Foreign Application Priority Data

Jan. 19, 1985 [JP] Japan ..... 60-6691

[51] Int. Cl.[4] ..... C08L 1/08; C08F 251/02; C08F 120/06

[52] U.S. Cl. ..... 524/733; 524/13; 524/832; 527/314

[58] Field of Search ..... 524/733, 832; 527/314

[56] References Cited

U.S. PATENT DOCUMENTS

| | | | |
|---|---|---|---|
| 3,682,856 | 8/1972 | Adams et al. | 524/733 |
| 3,953,386 | 4/1976 | Murphy et al. | 521/733 |
| 4,093,776 | 6/1978 | Aoki et al. | 526/909 |
| 4,135,943 | 1/1979 | Morishita et al. | 527/314 |
| 4,541,871 | 9/1985 | Obayashi et al. | 527/314 |

FOREIGN PATENT DOCUMENTS

| | | | |
|---|---|---|---|
| 2612846 | 10/1976 | Fed. Rep. of Germany | 527/314 |
| 53-46389 | 4/1978 | Japan . | |
| 55-84304 | 6/1980 | Japan . | |
| 0204673 | 11/1984 | Japan | 524/733 |

OTHER PUBLICATIONS

Derwent Abst. 80-56019C/32 Japan Nippon Jun. 25, 1980 J55084304.

*Primary Examiner*—Herbert J. Lilling

*Attorney, Agent, or Firm*—Sprung Horn Kramer & Woods

[57] ABSTRACT

A water absorbent crosslinked polymer having at least 70% by weight of acrylic acid monomeric units, 60 to 90% of the carboxyl groups of which are in the form of an alkali metal salt, produced by a method in which a mixture comprised of acrylic acid, 60 to 90% of the carboxyl groups of which are in the form of an alkali metal salt, and a fibrous cellulosic material is heated in the presence of a radical initiator. The polymerization temperature can be effectively controlled by smooth evaporation of water. The cross-linked polymer can absorb such a large amount of water as several hundred times the weight of the polymer in an excellent absorption rate, and finds applications as, for example, a disposable diaper and a sanitary napkin.

12 Claims, 1 Drawing Figure

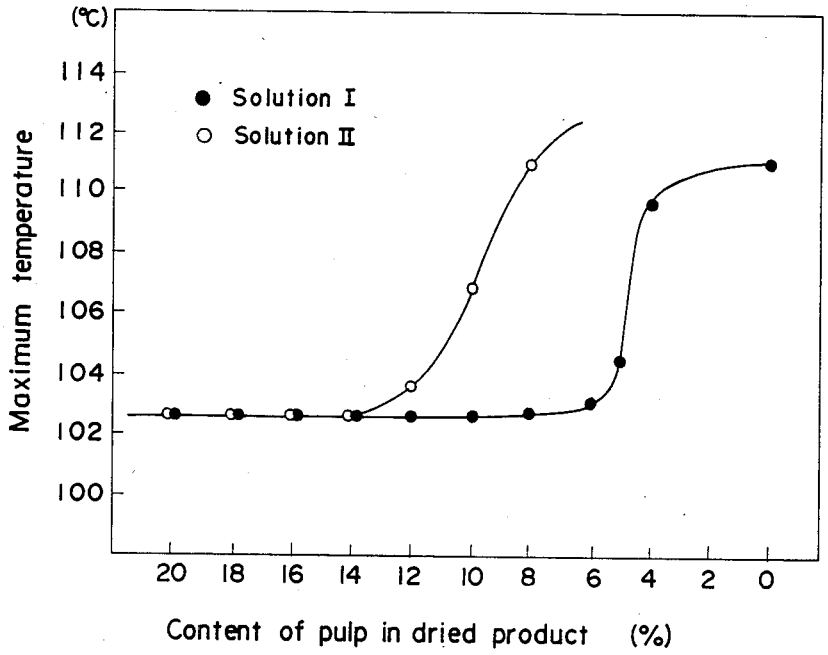
(°C)
114
112
110
108
106
104
102
100
Maximum temperature
Solution I
Solution II
20
18
16
14
12
10
8
6
4
2
0
Content of pulp in dried product (%)

WATER ABSORBENT CROSSLINKED POLYMER AND A METHOD OF PRODUCING THE SAME CONTAINING CELLULOSIS FIBERS

This invention relates to a water absorbent crosslinked polymer and a method of producing the same. More particularly, this invention is concerned with a water absorbent crosslinked polymer having at least 70% by weight of acrylic acid monomeric units, 60 to 90% of the carboxyl groups of which are in the form of an alkali metal salt, and a method in which a mixture comprised of acrylic acid, 60 to 90% of the carboxyl groups of which are in the form of an alkali metal salt, and a fibrous cellulosic material is heated in the presence of a radical initiator.

Known in the art are water absorbent polymers having acrylic acid monomeric units which can absorb water in an amount of several hundred times the weight of the polymer, exhibiting a high absorbency to urine and menstrual blood as well. The polymers are useful to produce a disposable diaper, a sanitary napkin or the like through a process comprising spreading the polymers in a pulverized form over a substrate such as tissue paper, pulp material or the like. With respect to such water absorbent polymers, there are many publications. For example, U.S. Pat. No. 3,669,103 discloses the following teaching. A water soluble polymer produced from a monomeric component such as acrylic acid and acrylamide exhibits a high degree of water absorbency when crosslinking of the polymer molecules is effected. As the method of effecting the crosslinking, there may be mentioned, for example, a method in which copolymerization is effected using a bifunctional monomer such as N,N-methylenebisacrylamide.

Generally, water absorbent polymers having acrylic acid monomeric units are produced by subjecting an aqueous solution of monomeric components containing acrylic acid as a major component which has been neutralized with a caustic alkali to give a neutral pH value to copolymerization reaction in the presence of a water soluble radical initiator. As minor components which may be optionally incorporated into the aqueous solution, there are known various comonomers such as acrylamide and maleic anhydride, and various crosslinkable monomers. With respect to the crosslinking of the polymer molecules, in addition to the above-mentioned method, there may be mentioned another method in which a crosslinking agent is reacted with the functional groups of a formed polymer during heat drying. In this connection, reference may be made to Japanese Patent Application Laid-Open Specification No. 55-84304/1980.

In the known processes of producing a water absorbent polymer having acrylic acid monomeric units, a difficulty is encountered in controlling the polymerization reaction of an aqueous solution of monomeric components. When a radical initiator is added to an aqueous solution containing 40% by weight or more of acrylic acid neutralized with sodium hydroxide to give a neutral pH value and the resulting mixture is heated, there rapidly occurs a polymerization reaction while producing a partially self-crosslinked polymer. After the initiation of the polymerization reaction, the viscosity of the aqueous solution increases and a gel is formed with the progress of crosslinking. While the polymerization reaction is accelerated due to the elevation of the temperature which is attributed to the heat of reaction, evaporation of the steam out of the reaction system is hindered due to the increased viscosity and the gelation of the mixture. As a result, removal of the heat of reaction becomes difficult, and the reaction proceeds uncontrollably with the formation of a popcorn-like material. Especially when the reaction system becomes a gel, a generally known "gel effect" occurs to further increase the reaction rate, thereby causing controlling of the polymerization reaction to be more difficult.

To obviate such a difficulty, there have been proposed the following polymerization methods. One of them is a reverse phase suspension polymerization method in which polymerization is effected in a dispersion having fine particles of the aqueous reaction solution dispersed in an oily phase. With respect to this method, reference may be made to, for example, Japanese Patent Application Laid-Open Specification No. 53-46389/1978. Another is a method in which polymerization is effected using a redox system radical initiator in a reaction vessel, which has a large contact area and thus can be advantageously utilized permitting control of the temperature, at a relatively low temperature, i.e. a temperature less than 80° C., over a prolonged period of time. In this method, crosslinking during the polymerization step can be prevented, and crosslinking of the polymer molecules can be effected during the heat drying step by the use of a polyhydric alcohol as a crosslinking agent. With respect to this method, reference may be made to Japanese Patent Application Laid-Open Specification No. 55-84304/1980.

In the former method, it is possible to polymerize acrylic acid in a high concentration aqueous solution. However, this method is disadvantageous because in this method a large amount of a hydrocarbon solvent must be used and a countermeasure against a fire is required, thereby inevitably leading to an increase in manufacturing cost. Further, in this method, it is difficult to practice a continuous process.

In the latter method, a continuous polymerization process is feasible. However, this method is also disadvantageous because in this method the polymerization reaction requires a prolonged reaction time and a complicated polymerization apparatus, and because in this method the concentration of the aqueous reaction solution is to be kept low to ensure controlling of the heat of polymerization. Therefore, in this method as well, reduction of the manufacturing cost cannot be expected.

As is apparent from the foregoing, all of the prior art methods are advantageous in some points but disadvantageous in other points.

With a view to developing a method of producing a water absorbent polymer having acrylic acid monomeric units which method is free from the above-mentioned drawbacks, we have made extensive and intensive studies, changing reaction conditions and making various trials.

As a result, it has unexpectedly been found that when a relatively small amount of pulp fibers are dispersed in an aqueous solution containing 30% by weight or more of acrylic acid which has been neutralized with caustic alkali to give a neutral pH value and the resulting dispersion is heated to effect polymerization reaction in the presence of a radical initiator such as potassium persulfate (hereinafter often referred to as "KPS"), the polymerization temperature can be effectively controlled due to the smooth evaporation of water from the reaction mixture. It has also unexpectedly been found that the resulting polymer product can absorb such a large amount of water as several hundred times the weight of the polymer in an excellent absorption rate. Based on these novel findings, the present invention has been completed.

It is, therefore, an object of the present invention to provide a novel water absorbent crosslinked polymer having acrylic acid monomeric units containing a fibrous cellulosic material, which can absorb such a large amount of water as several hundred times the weight of the polymer in an excellent absorption rate.

It is another object of the present invention to provide a novel method of producing such an excellent water absorbent crosslinked polymer which ensures stable operations and is free from the above-mentioned drawbacks of the prior art.

The foregoing and other objects, features and advantages of the present invention will be apparent to those skilled in the art from the following detailed description and applended claims taken in connection with the accompanying drawing which shows the effect of a cellulosic material on the control of polymerization temperature.

In one aspect of the present invention, there is provided a water absorbent crosslinked polymer having at least 70% by weight, based on the total weight of said polymer, of acrylic acid monomeric units, 60 to 90% of the carboxyl groups of said acrylic acid monomeric units being in the form of an alkali metal salt, produced by a method described below.

In another aspect of the present invention, there is provided a method of producing a water absorbent crosslinked polymer having at least 70% by weight, based on the total weight of said polymer, of acrylic acid monomeric units, 60 to 90% of the carboxyl groups of said acrylic acid monomeric units being in the form of an alkali metal salt, which comprises the steps of:

(1) providing an aqueous solution comprising water, at least 30% by weight, based on the total weight of said aqueous solution, of acrylic acid as a monomeric component, 60 to 90% of the carboxyl groups of said acrylic acid being in the form of an alkali metal salt, and a radical initiator;

(2) mixing the aqueous solution with a fibrous cellulosic material to obtain an aqueous mixture, thereby enabling the water of said mixture to smoothly evaporate at heating so that when said mixture is heated in the following step (3), the maximum temperature of said mixture is controlled as a result of a balance between the heat generation due to the polymerization reaction and the heat radiation by smooth water evaporation due to the fibrous cellulosic material;

(3) heating the obtained mixture to effect polymerization of said monomeric component, thereby obtaining a reaction product containing a crosslinked polymer together with the fibrous cellulosic material; and (4) subjecting said reaction product to heat drying, followed by pulverization.

Referring now to the accompanying drawing, explanation will be given on the effect of a fibrous cellulosic material on the control of the polymerization temperature. To a 40% by weight aqueous solution containing one mole of acrylic acid of which 80% of the carboxyl groups was neutralized with sodium hydroxide to give the sodium salt thereof was added 0.2% by weight of KPS to prepare Solution I. To portion of Solution I was added N,N'-methylenebisacrylamide in an amount of 0.15% by weight based on the weight of the acrylic acid of Solution I to give Solution II. To each of these aqueous solutions was added a purified fibrous pulp in predetermined amounts to obtain homogeneous dispersions. The thus obtained dispersions were placed in 500 ml-beakers and subjected to heating on a hot plate. When there was observed the initiation of a polymerization reaction with the generation of steam, the heating was stopped, followed by measurement of the maximum temperature of the reaction system by means of a thermometer placed in the central part of the reaction mixture. In the drawing is shown a relationship between the maximum temperature of the reaction mixture and the content of fibrous pulp in terms of percentage of the fibers in the dried product. As is seen from the drawing, in the case of Solution I having no crosslinking agent added thereto, the addition of about 5% by weight or more of fibrous pulp was effective to remove the heat of polymerization through the smooth evaporation of water, thereby preventing a rapid elevation of the polymerization temperature and ensuring effective control of the reaction. On the other hand, in the case of Solution II from which a gel was formed during the polymerization step due to the presence of a crosslinking agent, about 14% by weight or more of pulp content was needed for controlling the polymerization reaction. When the reaction mixture contained no fibrous pulp, the reaction proceeded uncontrollably with the formation of a popcorn-like material. From these test results, it has been confirmed that the polymerization reaction can be effectively controlled by the presence of a fibrous cellulosic material.

In the present invention, in an aqueous solution containing at least 30% by weight, based on the total weight of the aqueous solution, of a monomeric component is dispersed a fibrous cellulosic material in an amount ratio of monomeric component to cellulosic material of from 95/5 to 50/50 by weight, so that when the mixture is heated in step 3, the maximum temperature of the mixture is controlled in the range of from just above 100° C. to about 110° C. The resulting mixture is subjected to polymerization reaction. That is, the mixture is heated at a temperature of about 60° to about 110° C., preferably about 80° to 100° C. The heat of polymerization can be removed due to the smooth evaporation of water from the mixture. The polymerization reaction proceeds rapidly under controlled conditions, and generally terminates within 10 minutes. A preferred content of a monomeric component in the aqueous solution is 30% by weight or more from the viewpoint of production efficiency. It is especially preferred that the content do not exceed 60% by weight from the viewpoint of the solubility of alkali metal acrylates in water.

The fibrous cellulosic material incorporated in the aqueous solution exerts its effect by the formation of passages through which the steam can smoothly evaporate from the polymerization mixture heated by the heat of polymerization up to a temperature exceeding 100° C. It is surprising that the incorporation of a fibrous cellulosic material has a marked effect even in a small amount as shown in the drawing. Thus, it is to be noted that an aqueous solution containing acrylic acid in a high concentration can be subjected to polymerization in a simple form of reactor under controlled conditions. Therefore, the method of the present invention is extremely advantageous over the conventional methods from the economical point of view.

The kind of the fibrous cellulosic material to be employed in the present invention is not critical. However, it is generally preferred that a chemically purified wood pulp, cotton linter pulp or the like be employed. The term "pulp" used herein means a mass of fibrous pieces composed of cellulose as the major component. The pulp to be incorporated is brought to pieces, and is dispersed homogeneously in the aqueous solution to give a mixture containing fibrous pieces dispersed therein.

The size of the fibrous cellulosic material is not critical. However, in the present invention, it is preferred that the fibrous cellulosic material have a length of 0.5 to 10 mm and a diameter of 1 to 50 denier. The amount ratio of monomeric component to fibrous cellulosic material in the present invention is in the range of from 95/5 to 50/50 by weight. The use of the fibrous cellulosic material over this range is disadvantageous because the presence of more pulp causes pulverization of the dried product into a uniform pulverized product to be difficult. On the other hand, the use of the fibrous cellulosic material under this range is disadvantageous from the viewpoint of controlling of the polymerization reaction.

Moreover, it should be noted that in addition to the controlling of the polymerization reaction, the incorporation of a fibrous cellulosic material has an effect of accelerating the drying of water-containing product and also an effect of improving of the absorption rate of the ultimate pulverized product. These effects will be easily understood from the fact that the incorporation of a fibrous cellulosic material renders the ultimate solid product porous.

As the materials to be optionally added in the present invention, there may be mentioned a wide variety of known compounds. In the present invention, a water soluble monomeric component such as methacrylic acid, maleic acid, fumalic acid, acrylamide, and methacrylamide may be copolymerized as a minor component. There is no significant difference between the homopolymerization of acrylic acid and the copolymerization of monomers having acrylic acid as a major component with respect to the characteristics of polymerization reaction. The same is true with respect to the effect of fibrous cellulosic material incorporation on controlling of the polymerization reaction.

In the present invention, the aqueous solution of acrylic acid may also comprise starch or a water soluble cellulose derivative such as carboxymethyl cellulose which forms a graft polymer during the polymerization reaction (see Japanese Patent Application Laid-Open Specification No. 56-70011/1981). In this case as well, the effect of fibrous cellulosic material incorporation on the controlling of polymerization reaction is substantially the same as that in the case of the homopolymerization.

Crosslinking between the polymer molecules may be effected by (1) self-crosslinking, (2) copolymerization with a crosslinkable polyfunctional monomer and (3) post-crosslinking of the produced polymers by a crosslinking agent.

Self-crosslinking occurs when the aqueous solution contains 30% by weight or more of a monomeric component.

As the crosslinkable polyfunctional monomer to be used in the copolymerization, there may be mentioned, for example, N,N'-methylenebisacrylamide, ethylene glycol bisacrylate, polyethylene glycol bisacrylate, and the like.

As the post-crosslinking agent to be used for the post-crosslinking, there may be mentioned, for example, diethylene glycol, glycerin, ethylene glycol diglycidyl ether and the like.

Of the crosslinking methods, copolymerization with a crosslinkable polyfunctional monomer and post-crosslinking of the produced polymers by a crosslinking agent are generally preferred from the viewpoint of crosslinking density.

The above-mentioned crosslinking agents and methods of crosslinking are generally known in the art.

In the present invention, the aqueous solution contains, at least 30% by weight, preferably 30 to 60% by weight, based on the total weight of the aqueous solution, of a monomeric component of which 60 to 90% of the carboxyl groups are in the form of an alkali metal salt. Conversion of 60 to 90%, preferably 60 to 80%, of the carboxyl groups of the monomeric component into an alkali metal salt may be effected according to various methods. For example, it may be effected by adding a predetermined amount of a caustic alkali solution, such as sodium hydroxide solution, to the solution of the monomeric component. The above-mentioned aqueous solution generally exhibits a neutral pH in the range of 5 to 8.

In the present invention, a radical initiator may be added to the aqueous solution in an amount of 0.001 to 1.0%, based on the total weight of the aqueous solution. As the suitable initiator, there may be mentioned, for example, hydrogen peroxide, ammonium persulfate, sodium persulfate, potassium persulfate, peracetic acid and the like.

Incorporation of a fibrous cellulosic material in the aqueous solution should be carried out in a manner minimizing the damage of the fibrous cellulosic materials. If the fibrous material is damaged thereby to give a powdery material, its absorbency of the aqueous solution decreases. As a result, the absorption of the heat of polymerization and the smooth evaporation of water from the aqueous solution cannot be attained effectively. In the case where a pulp material is employed as the fibrous cellulosic material, a roughly broken pulp material is mixed with an aqueous solution and brought to pieces in the wet form to obtain a uniform dispersion having less damaged fibrous pulp therein.

Polymerization reaction of the monomeric component can be allowed to proceed by heating the reaction mixture, during which the steam comes out of the reaction mixture due to the heat of polymerization. With the progress of the polymerization, the viscosity of the reaction mixture increases and a gel is formed, but the smooth evaporation of water can be assured by stirring the mixture. Moreover, the polymerization may be readily carried out in a continuous manner.

The resulting polymerization product is thereafter subjected to heat drying by means of a drier such as drum drier, followed by pulverization thereof. The pulverized product is composed of a fibrous cellulosic material and a water absorbent polymer attached thereto. The higher the fibrous cellulosic material content, the lower the apparent density of the ultimate pulverized product. On the other hand, the absorbency of the pulverized product increases in proportion to the polymer content.

The pulverized product is often applied by spreading the same over a paper or other fibrous substrates in the process for producing a disposable diaper, a sanitary napkin or the like. In such a case, a pulverized product having a relatively low apparent density exhibits a good compatibility with the paper or substrate and is excellent in adherence to the paper or substrate even under a physical influence such as vibration. The apparent density of the pulverized product can be regulated in the present invention in a manner mentioned above. The water absorbency of the product of the present invention can be varied in the range of 100 to 1000 times the weight of the polymer by varying the crosslinking density of the polymer. The product is also highly adsorbent of urine and blood, and therefore can be suitably employed as an absorbent for disposable diapers, sanitary napkins or the like.

The product of the present invention is excellent in absorption rate over the conventional polymers used for disposable diapers, sanitary napkins or the like. The absorption rate is a property which is very important for the above purposes.

According to the present invention, there are provided a crosslinked polymer which can absorb such a large amount of water as several hundred times the weight of the polymer in an excellent absorption rate, and a novel, efficient process for producing such a crosslinked polymer.

The present invention will be illustrated in more detail with reference to the following Examples, which should not be construed to be limiting the scope of the present invention. The parts are by weight unless otherwise indicated.

EXAMPLE 1

To a solution made by dissolving 30 parts of sodium hydroxide (purity: 93%) in 80 parts of water was added 72 parts of acrylic acid to prepare an aqueous solution. The solution had a pH value of 5.2. 70% of the entire amount of the acrylic acid had been converted to its sodium salt. To the obtained solution was added 0.2 part of potassium persulfate.

120 parts of the resulting aqueous solution were sprayed over 40 g of commercially available absorbent cotton. The solution was allowed to permeate evenly into the cotton to obtain a mixture. The mixture was put in a reaction vessel, flushed with nitrogen gas and closed. The vessel was heated. When the temperature of the mixture was elevated to about 80° C., initiation of polymerization reaction was observed. When the temperature of the mixture was further elevated and water evaporation was observed, heating of the vessel was stopped. At this time, the temperature of the mixture was about 100° C. The polymerization reaction terminated within about 5 minutes. The maximum temperature of the mixture was about 103° C.

Thereafter, the resulting product was dried at a temperature of 120° C. and pulverized into a powdery material. It was found that the powdery material contained 40% of fibrous cellulosic material based on the weight of the dried product. The absorbency of the product was measured as follows. 1 g of the powdery product was separately put in a large volume of water and a 0.9% sodium chloride aqueous solution, and 30 minutes later the formed gel was filtered with a 60-mesh sieve and subjected to weighing. Results are shown in Table 1.

TABLE 1

| | Absorbency (g/g) | |
|---|---|---|
| | Water | 0.9% NaCl Solution |
| Powder | 180 | 22 |

TABLE 1-continued

| | Absorbency (g/g) | |
|---|---|---|
| | Water | 0.9% NaCl Solution |
| Polymer* (Calculated) | 450 | 54 |

*Absorbency of the polymer contained in the powdery product

EXAMPLES 2 TO 5

64 parts of sodium hydroxide (purity: 93%) were dissolved in 234 parts of water to obtain a solution. To the solution were added 144 parts of acrylic acid and 0.1 part of N,N'-methylenebisacrylamide, and, after cooling, was added 0.4 part of potassium persulfate. The resulting aqueous solution had a pH value of 5.5. 75% of the entire amount of the acrylic acid had been converted to its sodium salt.

In the aqueous solution was dispersed evenly a commercially available chemically purified absorbent pulp in proportions as indicated in Table 2.

TABLE 2

| Example | aqueous solution | absorbent pulp |
|---|---|---|
| 2 | 110 parts | 5 parts |
| 3 | 70 parts | 5 parts |
| 4 | 50 parts | 5 parts |
| 5 | 30 parts | 5 parts |

These mixtures were heated in nitrogen atmosphere while stirring substantially in the same manner as described in Example 1. Polymerization reaction proceeded with vigorous generation of steam and terminated within 10 minutes. It was found that the temperature of the reaction mixture never exceeded 104° C.

The above-obtained products were dried on a drum drier having a surface temperature of 130° C., and further in a drier kept at 120° C. After drying, the products were pulverized.

Absorbencies of the pulverized products were measured in substantially the same manner as in Example 1. Pulp contents were calculated on the basis of the weight of the products. Results are shown in Table 3.

TABLE 3

| Example | Content of Pulp (%) | Absorbency | |
|---|---|---|---|
| | | Water (g/g) | 0.9% NaCl Solution (g/g) |
| 2 Powder | 9 | 565 | 53 |
| Polymer (calculated) | | 620 | 58 |
| 3 Powder | 15 | 520 | 48 |
| Polymer (calculated) | | 610 | 56 |
| 4 Powder | 21 | 480 | 40 |
| Polymer (calculated) | | 605 | 51 |
| 5 Powder | 30 | 410 | 31 |
| Polymer (calculated) | | 580 | 44 |

EXAMPLE 6

33.5 parts of sodium hydroxide (purity: 93%) were dissolved in 131 parts of water to obtain a solution. To the solution were added 64.8 parts of acrylic acid, 8.6 parts of methacrylic acid and 0.06 part of ethylene glycol diacrylate, and, after cooling, was added 0.2 part of ammonium persulfate. The resulting aqueous solution has a pH value of 5.7. The molar ratio of methacrylic acid to acrylic acid was 1/9, and 78% of the entire amount of these acids had been converted to their sodium salts.

To 100 parts of the above-obtained aqueous solution was added 12 parts of commercially available absorbent pulp to obtain a uniform mixture. The mixture was heated in nitrogen atmosphere while stirring substantially in the same manner as described in Example 1. Polymerization reaction proceeded with the generation of steam and terminated within 10 minutes. Temperature of the reaction system rose up to 103° C. The obtained product was treated in substantially the same manner as in Examples 2 to 5 to obtain a dried powder. The powder contained 25% of pulp. Results of measured absorbency are shown in Table 4.

TABLE 4

| | Absorbency (g/g) | |
|---|---|---|
| | Water | 0.9% NaCl Solution |
| Powder | 410 | 35 |
| Polymer (Calculated) | 550 | 47 |

EXAMPLE 7

To a solution made by dissolving 30 parts of sodium hydroxide (purity: 93%) in 73 parts of water was added 72 parts of acrylic acid to prepare an aqueous solution. The aqueous solution had a pH value of 5.2. 70% of the entire amount of the acrylic acid had been converted to its sodium salt. To the obtained solution were added 12 parts of soluble starch and 0.2 part of potassium persulfate.

5.8 parts of absorbent pulp were dispersed evenly in 80 parts of the resulting aqueous solution to produce a mixture. The mixture was heated in nitrogen atmosphere while stirring substantially in the same manner as described in Example 1. Polymerization reaction proceeded with the generation of steam and terminated within 10 minutes. The maximum temperature of the reaction system was 103° C. The obtained product was treated in substantially the same manner as in Examples 2 to 6 to obtain a dried powdery product. The product had a pulp content of 12% as calculated on the basis of the weight of the dried product. Results of the measured absorbency are shown in Table 5.

TABLE 5

| | Absorbency (g/g) | |
|---|---|---|
| | Water | 0.9% NaCl Solution |
| Powder | 405 | 37 |
| Polymer (Calculated) | 460 | 42 |

EXAMPLE 8

To a solution made by dissolving 34.4 parts of sodium hydroxide (purity: 93%) in 148 parts of water were added 72 parts of acrylic acid, 0.1 part of diethylene glycol and 0.1 part of potassium persulfate to prepare an aqueous solution. The solution had a pH value of 6.0. 80% of the entire amount of the acrylic acid had been converted to its sodium salt.

5 parts of absorbent pulp was dispersed evenly in 80 parts of the above-obtained aqueous solution to prepare a mixture. Then, the mixture was heated in nitrogen atmosphere while stirring substantially in the same manner as described in Example 1. Polymerization reaction proceeded with the generation of steam and terminated within 10 minutes. Maximum temperature of the reaction system was 103° C.

The obtained product was cut to pieces and dried in a vacuum drier at room temperature. The pieces were partially soluble in water and could not be subjected to measurement of absorbency.

Separately, another portion of the product was dried in a drier at 130° C. for 2 hours and thereafter pulverized to obtain a powdery product. The powdery product had a pulp content of 16% as calculated on the basis of the weight of the powdery product. Results of measured absorbency are shown in Table 6.

TABLE 6

| | Absorbency (g/g) | |
|---|---|---|
| | Water | 0.9% NaCl Solution |
| Powder | 320 | 31 |
| Polymer (Calculated) | 380 | 37 |

COMPARATIVE EXAMPLE

An aliquot of the aqueous solution as employed in Examples 2 to 5 was poured into a vessel made of stainless steel to form a thin layer of the solution having a thickness of 4 mm. The vessel was put on a hot plate maintained at a temperature of 100° C. and the vessel was flushed with nitrogen gas. Because the reaction mixture was in the form of a thin layer, water evaporation was smooth, and the polymerization reaction was completed within about 10 minutes.

The resulting product obtained in the form of a sheet was dried in a dryer at a temperature of 120° C. for 4 hours and pulverized into a powdery product to obtain a comparative sample. The powdery product obtained in Example 2 and the above-mentioned comparative sample were sifted with a sieve to obtain respective powdery products having a particle diameter of 40 to 80 mesh (Tyler). The absorbencies of the respective powdery products for water and 0.9% NaCl solution were measured by the method described in Example 1. Results are shown in Table 7.

TABLE 7

| | Absorbency (g/g) | |
|---|---|---|
| | Water | 0.9% NaCl Solution |
| Example 2 | 570 | 53 |
| (Polymer*) | (620) | (57) |
| Comparative Sample | 630 | 56 |

*Absorbency of the polymer contained in the powdery product

It is seen from Table 7 that the polymers of both samples have substantially the same absorbency.

Thereafter, the absorption rates of both samples were respectively measured. 0.5 g of the powdery product of each sample was put in a tea bag made of a nonwoven rayon fabric having a size of 7 cm×7 cm. The tea bag was put in a 0.9%. NaCl solution, lifted after predetermined periods of time and weighed to measure the absorbency. Results are shown in Table 8.

TABLE 8

| | Absorption Rate Absorbency (g/g) | | |
|---|---|---|---|
| Time (min) | Example 2 | (Polymer*) | Comparative Sample |
| 2 | 39 | (43) | 29 |
| 5 | 44 | (48) | 36 |
| 30 | 45 | (50) | 46 |

TABLE 8-continued

| Time (min) | Example 2 | Absorption Rate Absorbency (g/g) (Polymer*) | Comparative Sample |
|---|---|---|---|
| 60 | 45 | (50) | 52 |

With respect to the sample of Example 2, the absorbency thereof reached 90% of the equilibrium value within 2 minutes and almost came to equilibrium within 5 minutes. In contrast, with respect to the comparative sample, the absorbency thereof reached only 70% of the equilibrium value within 5 minutes. Incidentally, it is known that at equilibrium in the case of the tea bag method is lower than that in the case of the method described in Example 1.

What is claimed is:

1. A water absorbent crosslinked polymer having at least 70% by weight, based on the total weight of said polymer, of acrylic acid monomeric units, 60 to 80% of the carboxyl groups of said acrylic acid monomeric units being in the form of an alkali metal salt, produced by a method comprising the steps of:

(1) providing an aqueous solution comprising water, at least 30% by weight, based on the total weight of said aqueous solution, of acrylic acid as a monomeric component, 60 to 80% of the carboxyl groups of said acrylic acid being in the form of an alkali metal salt, and a radical initiator;

(2) mixing the aqueous solution with a fibrous cellulosic material to obtain an aqueous mixture, thereby enabling the water of said mixture to smoothly evaporate at heating so that when said mixture is heated in the following step (3), the maximum temperature of said mixture is controlled as a result of a balance between the heat generation due to the polymerization reaction and the heat radiation by smooth water evaporation due to the fibrous cellulosic material;

(3) heating the obtained mixture to effect polymerization of said monomeric component, thereby obtaining a reaction product containing a crosslinked polymer together with the fibrous cellulosic material; and (4) subjecting said reaction product to heat drying, followed by pulverizaton.

2. A polymer according to claim 1, wherein in step (3), the mixture is heated at a temperature of about 60° to about 110° C.

3. A polymer according to claim 2, wherein the mixture is heated at a temperature of about 80° to about 100° C.

4. A polymer according to claim 1, wherein said radical initiator is employed in an amount of 0.001 to 1.0%, based on the total weight of the aqueous solution.

5. A polymer according to claim 1, wherein the aqueous solution is mixed with the fibrous cellulosic material in an amount ratio of monomeric component to fibrous cellulosic material of 95/5 to 50/50 by weight, so that when the mixture is heated in step (3), the maximum temperature of the mixture is controlled in the range of from just above 100° C. to about 110° C.

6. A polymer according to claim 1, wherein said aqueous solution further comprises as a monomeric component at least one member selected from the group consisting of a water soluble crosslinkable polyfunctional monomer and a water soluble copolymerizable monomer.

7. A polymer according to claim 1, wherein said aqueous solution further comprises at least one member selected from the group consisting of a water soluble post-crosslinking agent, a water soluble starch and a water soluble cellulose derivative.

8. A polymer according to claim 6, wherein said aqueous solution comprises water, 30 to 60% by weight, based on the total weight of said aqueous solution, of acrylic acid and a water soluble copolymerizable monomer as monomeric components and a radical initiator, said copolymerizable monomer being selected from the group consisting of methacylic acid, maleic acid, fumaric acid, itaconic acid, acrylamide, methacylamide and mixtures thereof, 60 to 80% of the carboxyl groups of each of said acrylic acid, methacrylic acid, maleic acid, fumaric acid and itaconic acid being in the form of an alkali metal salt, the amount ratio of said acrylic acid to said copolymerizable monomer being at least 70/30 by weight.

9. A polymer according to claim 1, wherein said cellulosic material is a chemically purified pulp.

10. A polymer according to claim 9, wherein said chemically purified pulp is a chemically purified wood pulp or a chemically purified cotton linter pulp.

11. A method of producing a water absorbent crosslinked polymer having at least 70% by weight, based on the total weight of said polymer, of acrylic acid monomeric units, 60 to 90% of the carboxyl groups of said acrylic acid monomeric units being in the form of an alkali metal salt, which comprises the steps of:

(1) providing an aqueous solution comprising water, at least 30% by weight, based on the total weight of said aqueous solution, of acrylic acid as a monomeric component, 60 to 90% of the carboxyl groups of said acrylic acid being in the form of an alkali metal salt, and a radical initiator;

(2) mixing the aqueous solution with a fibrous cellulosic material to obtain an aqueous mixture, thereby enabling the water of said mixture to smoothly evaporate at heating so that when said mixture is heated in the following step (3), the maximum temperature of said mixture is controlled as a result of a balance between the heat generation due to the polymerization reaction and the heat radiation by smooth water evaporation due to the fibrous cellulosic material;

(3) heating the obtained mixture to effect polymerization of said monomeric component, thereby obtaining a reaction product containing a crosslinked polymer together with the fibrous cellulosic material; and (4) subjecting said reaction product to heat drying, followed by pulverization.

12. A method according to claim 11, wherein 60 to 80% of the carboxyl groups of said acrylic acid is in the form of an alkali metal salt.

* * * * *